US011718463B1

(12) United States Patent
LoBiondo

(10) Patent No.: US 11,718,463 B1
(45) Date of Patent: Aug. 8, 2023

(54) COSMETIC CONTAINER

(71) Applicant: Paul LoBiondo, Sea Bright, NJ (US)

(72) Inventor: Paul LoBiondo, Sea Bright, NJ (US)

( * ) Notice: Subject to any disclaimer, the term of this patent is extended or adjusted under 35 U.S.C. 154(b) by 274 days.

(21) Appl. No.: 16/941,753

(22) Filed: Jul. 29, 2020

Related U.S. Application Data

(63) Continuation-in-part of application No. 16/601,903, filed on Oct. 15, 2019, now Pat. No. 11,596,217.

(51) Int. Cl.

| | |
|---|---|
| ***B65D 81/18*** | (2006.01) |
| ***A45D 34/00*** | (2006.01) |
| ***A45D 34/04*** | (2006.01) |
| ***B65D 47/08*** | (2006.01) |
| ***B65D 25/20*** | (2006.01) |

(52) U.S. Cl.
CPC ..... *B65D 81/18* (2013.01); *A45D 34/04* (2013.01); *B65D 25/20* (2013.01); *B65D 47/08* (2013.01); *A45D 2034/002* (2013.01); *A45D 2200/155* (2013.01)

(58) Field of Classification Search
CPC ..... A45D 2200/155; B05B 9/002; B05B 11/0002; B05B 11/3059; B65D 83/22
See application file for complete search history.

(56) References Cited

U.S. PATENT DOCUMENTS

| | | | | |
|---|---|---|---|---|
| 4,584,847 A | | 4/1986 | Martello | |
| 5,502,981 A | * | 4/1996 | Sullivan | F25D 3/08 62/372 |
| 6,415,624 B1 | * | 7/2002 | Connors | F25D 31/007 62/530 |
| 6,907,750 B2 | * | 6/2005 | Suh | A47J 27/002 62/371 |
| 7,328,859 B2 | * | 2/2008 | Hornsby | B05B 1/3436 222/481.5 |
| 9,889,982 B2 | * | 2/2018 | Falcon | B65D 83/386 |
| 2007/0044488 A1 | * | 3/2007 | Habatjou | F25D 3/107 62/294 |

* cited by examiner

*Primary Examiner* — David P Angwin
*Assistant Examiner* — Bradley S Oliver
(74) *Attorney, Agent, or Firm* — Sanchelima & Associates, P.A.; Christian Sanchelima; Jesus Sanchelima

(57) ABSTRACT

A cosmetic container for storing cosmetic product is disclosed herein. The cosmetic container comprises a container having a thermal container receiving section. The cosmetic container further comprises a first end and a second end with the container including an opening at the second end used to store cosmetic product such as sunscreen therein. The second end of the cosmetic container also includes a neck portion comprising a threaded portion to receive a head. The cosmetic container further comprises a thermal container for storing a cooling agent. The thermal container is received in the thermal container receiving section for cooling down the cosmetic product stored in the container. Another embodiment includes a thermal assembly with a thermal rod mounted onto a base plate that is inserted into a container. The container may include a spray nozzle cap mounted to a top end.

1 Claim, 5 Drawing Sheets

COSMETIC CONTAINER

1. OTHER RELATED APPLICATIONS

The present application is a continuation-in-part of pending U.S. patent application Ser. No. 16/601,903 filed on Oct. 15, 2019, which is hereby incorporated by reference.

BACKGROUND OF THE INVENTION

2. Field of the Invention

The present invention generally relates to cosmetic containers. More specifically, the present invention relates to a cosmetic container comprising a container and a thermal compartment mounted to the container for cooling down a cosmetic product contained in the container.

3. Description of the Related Art

It is known that cosmetic containers are used to store cosmetics, facial, hair care and beauty products. The cosmetic products may include, but not limited to, face cream, sunscreen lotion, skin care products, skin gel and so on. As known, the cosmetic products are used for improving the external beauty of a user, as they provide nutrients to the user's skin and retain moisture in the skin. Further, the cosmetic products block ultraviolet light from sun or air from being in direct contact with the skin and protect the user's skin. It is also known these products are best applied to a user's skin when at a cool temperature. The present invention addresses this cooling issue by providing a sunscreen comprising a gel-like substance for protecting human skin from UV rays, wherein the substance contains a combined cooling agent and a sunblock agent in a rigid plastic container that has an integrated freezer pack housed within the container. The freezer pack is a sealed cylindrical tube that contains a freezable substance.

Although the effectiveness of the cosmetic products depends on the ingredients used in the cosmetic products, manufacturers of the cosmetic products focus on design of the cosmetic containers in which the cosmetic products are stored. It is well documented that the using cosmetic products at a low temperature provides a moist and refreshing feel to the user and results in cooling down of the body. Several attempts have been made in the past to provide cooling devices for cosmetics. One such example is disclosed in U.S. Pat. No. 4,584,847. In U.S. Pat. No. 4,584,847A, a new instant cooling device for cosmetics is disclosed. Unique light weight and small refrigerator system is used in combination with a safety device to reinstate the proper hardness and consistency of facial cosmetics by cooling. The instant cooling device comprises pressure vessel with valve containing liquid refrigerant and adequate release mechanism to allow efficient cooling of personal size cosmetics. However, the reference disclosed is provided in unnecessarily complex and inefficient way. The disclosure fails to address the issue of providing a user with an efficient and effortless system to keep a user's cosmetic products cool. The present invention addresses these issues by providing a cosmetic container having a thermal container receiving section. The thermal container receiving section is adapted to receive a thermal container that is configured to keep cosmetics stored within cool in an effortless and efficient manner.

Other documents describing the closest subject matter provide for a number of more or less complicated features that fail to solve the problem in an efficient and economical way. None of these patents suggest the novel features of the present invention. Specifically, none of the disclosures in the art disclose a cosmetic container comprising a container and a thermal compartment mounted to the container for cooling down a cosmetic product contained in the container.

Therefore, there is a need in the art for a cosmetic container comprising a container and a thermal compartment removably mounted to the container for cooling down a cosmetic product contained in the container.

SUMMARY OF THE INVENTION

It is one of the objects of the present invention to provide a cosmetic container for storing cosmetic product and that avoids the drawbacks of the prior art.

It is one object of the present invention to provide a cosmetic container comprising a container and a thermal container storing a cooling agent. The thermal container when mounted to the container storing cosmetic product reduces the temperature of the cosmetic product thereby creating a cooling effect to a user applying said cosmetic product.

It is one object of the present invention to removably mount the thermal container to a container storing cosmetic product for cooling the cosmetic product thereby creating an efficient system for cooling multiple cosmetic products.

It is one object of the present invention to provide a cosmetic container for storing cosmetic product at a low temperature, and when applied on user's skin which allows the user to stay cool and comfortable in sun and hot temperatures.

Further objects of the invention will be brought out in the following part of the specification, wherein detailed description is for the purpose of fully disclosing the invention without placing limitations thereon.

BRIEF DESCRIPTION OF THE DRAWINGS

With the above and other related objects in view, the invention consists in the details of construction and combination of parts as will be more fully understood from the following description, when read in conjunction with the accompanying drawings in which.

V. DETAILED DESCRIPTION OF THE EMBODIMENTS OF THE INVENTION

The following detailed description is intended to provide example implementations to one of ordinary skill in the art, and is not intended to limit the invention to the explicit disclosure, as one or ordinary skill in the art will understand that variations can be substituted that are within the scope of the invention as described.

Figure 1:
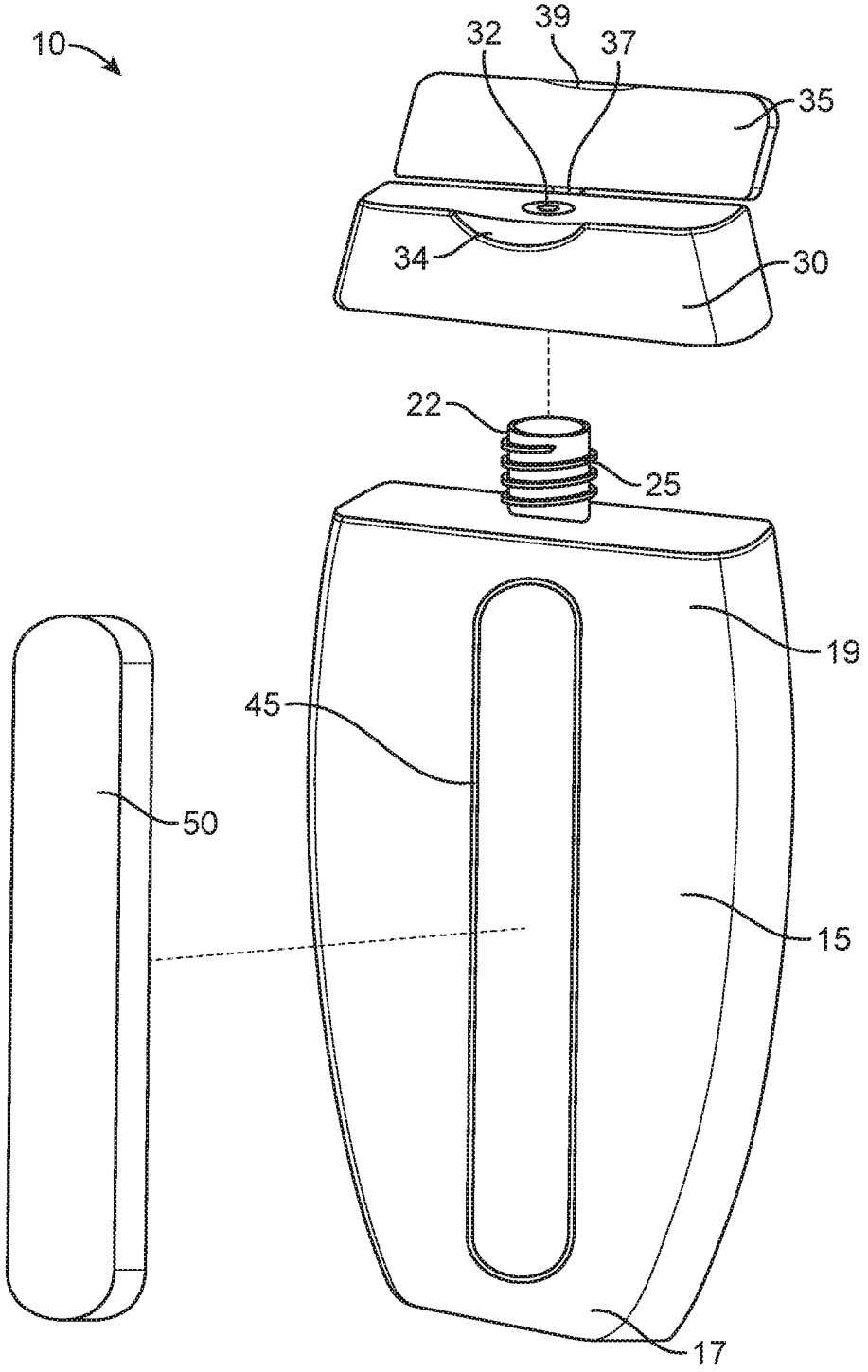
FIG. 1 illustrates an exploded view of a cosmetic container 10, in accordance with one embodiment of the present disclosure wherein a container 15, a head 35, and a thermal container 50 may be observed.
Figure 2:
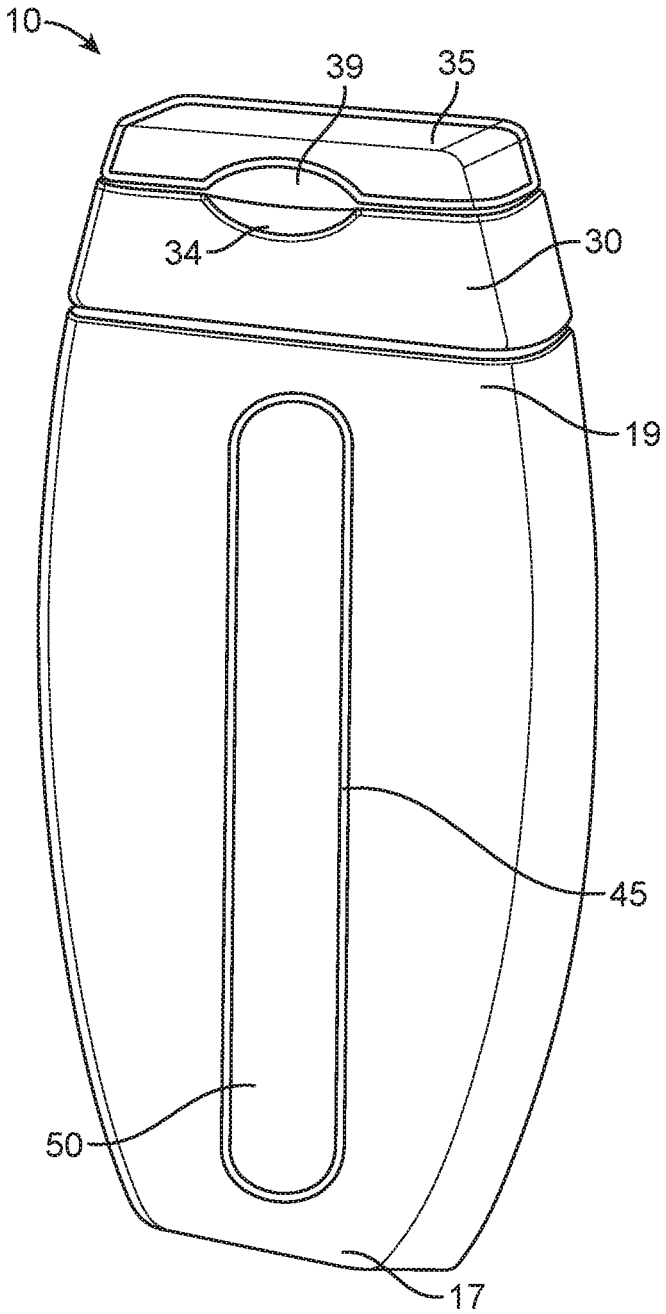
FIG. 2 depicts an isometric view of said cosmetic container 10, wherein said thermal container 50 is seen attached to said container 15 through means of thermal container receiving section 45.
Figure 3:
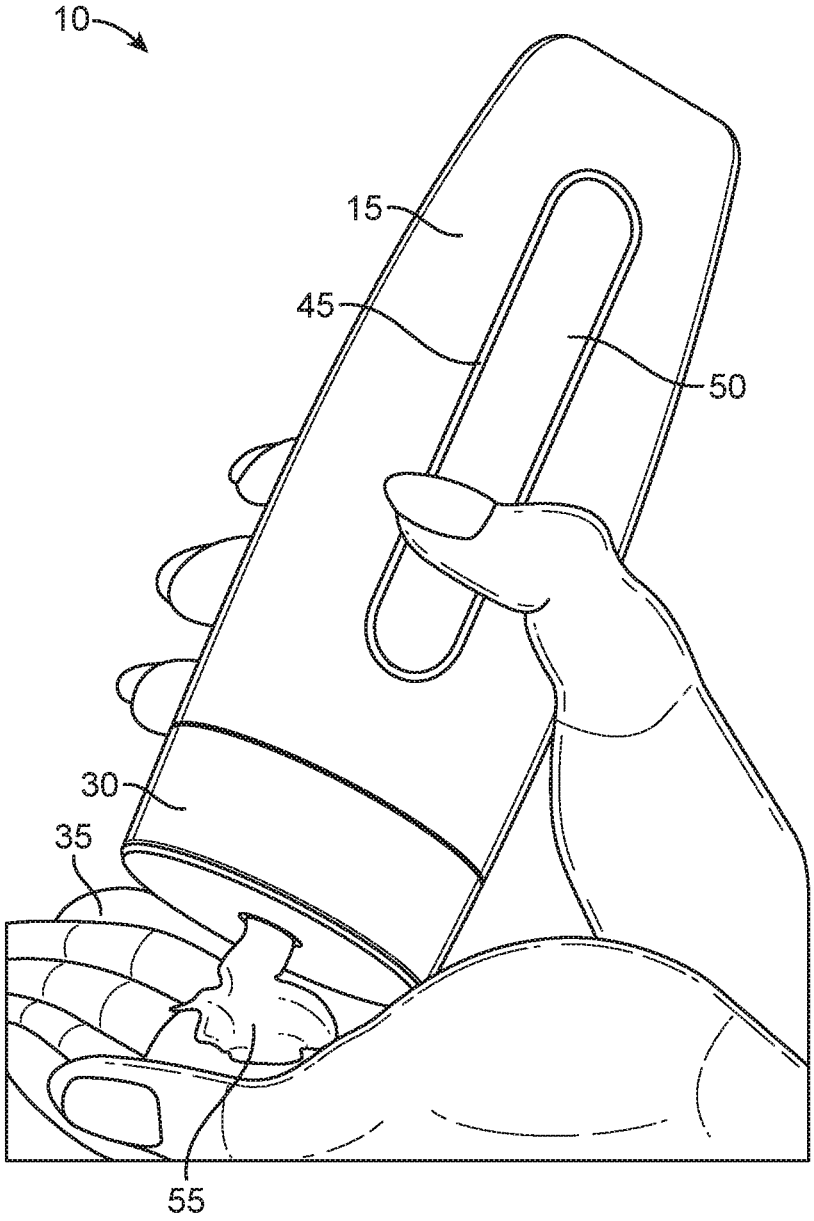
FIG. 3 illustrates cosmetic product 55 being dispensed from the cosmetic container 10, in accordance with one embodiment of the present disclosure.

Various features and embodiments of a cosmetic container are explained in conjunction with the description of FIGS. 1-3.

Referring to FIG. 1, an exploded view of a cosmetic container 10 is shown, in accordance with one embodiment of the present disclosure. The cosmetic container 10 comprises a container 15. The container 15 may indicate a bottle, box, case, tube and so on. The container 15 might be made up of a high density plastic or any other suitable material. The container 15 might be provided in variety of shapes and sizes. In one example, the container 15 might be provided in cylindrical shape. In another example, the container 15 might be provided in oval shape with flat base. In another example, the container 15 might be provided in a curved shape with flat base.

The container 15 may comprise a first end 17 and a second end 19. The first end 17 might indicate a bottom end of the container 15. The second end 19 might indicate a top end of the container 15. At the second end 19, the container 15 may comprise a neck portion 22. It should be understood that the neck portion 22 might be provided either as an integral part of the container 15 or as a separate part from that of the container 15. The neck portion 22 may comprise a threaded portion 25 on its surface.

Further, the cosmetic container 10 comprises a head 30 removably mounted to the container 15 via the neck portion 22. The head 30 may comprise internal threading which is used to mount to the neck portion 22 at the threaded portion 25. Further, the head 30 may comprise an opening 32 provided in alignment with the neck portion 22 such that product stored in the container 15 is made to come out through the opening 32 when pressure is exerted on the container 15. In one example, the head 30 may be provided with a first recess portion 34 for allowing a user to have grip while holding the head 30.

Further, the cosmetic container 10 comprises a cap or lid 35 mounted to the head 30 using a hinge 37. Further, the cap 35 comprises a second recess portion 39, which allows the user to operate the cap 35.

In one implementation, the container 15 is provided with a thermal container receiving section 45. It should be understood that the thermal container receiving section 45 might be provided at one of the sides of the container 15. The thermal container receiving section 45 might be provided in variety of shapes and sizes. It should be understood that the thermal container receiving section 45 might be formed by cutting a portion of the container 15 or by molding the container 15 to include the thermal container receiving section 45, as shown in FIG. 1.

Further, the cosmetic container 10 is provided with a thermal container or freezer pack 50. The thermal container 50 might be provided as a sealed cylindrical tube made up of plastic or fabric or synthetic or polyethylene, or paper or any other suitable material. As can be seen in FIG. 1, the thermal container 50 is provided in the shape of the thermal container receiving section 45, such that the thermal container 50 is mountable to the container 15 at the thermal container receiving section 45.

Referring to FIG. 2, the head 30 mounted to the container 15 at the neck portion 22 is shown. As specified above, the cap 35 is mounted to the head 30 using the hinge 37. As such, the cap 35 can be operated to close the opening 32 of the head 30. Further, the thermal container 50 is mounted to the container 15 at the thermal container receiving section 45.

Referring to FIG. 3, the container 15 might be used to store a cosmetic product 55. The cosmetic product 55 may include, but not limited to, face cream, sunscreen lotion, skin care products, skin gel and so on. In accordance with one exemplary embodiment, the container 15 is used to store the cosmetic product 55 i.e., sunscreen in gel form. However, it should be understood that the cosmetic product 55 might be used to other forms such as cream or foam form. In one example, the cosmetic product 55 might be formulated to block sunlight and to provide a cooling effect to a user when applied. In one example, the cosmetic product 55 might be using ingredients such as menthol, oxybenzone and zinc oxide. In the above example, menthol may act a cooling agent and oxybenzone and zinc oxide may block ultraviolet rays when applied on the user's skin. It should be understood that the above composition is used for exemplary purpose; other compositions may also be used to provide cooling effect when applied to the user's skin.

Further, the thermal container 50 might be provided with a cooling agent or cooling substance that is kept in frozen state inside the thermal container 50. In one example, the thermal container 50 might be permanently mounted to the container 15 such that the thermal container 50 will be disposed off along with the container 15 once the cosmetic product 55 is used up. In another example, the thermal container 50 might be removably mounted to the container 15 such that the thermal container 50 can be reused with another container 15, or the cosmetic product 55 can be refilled into the container 15 for longer use.

It should be understood that when the thermal container 50 filled with cooling agent is mounted to the container 15, the walls of the container 15 comes in contact with the thermal container 50 and gets cold. Further, the cosmetic product 55 contained in the container 15 gets cold. As such, when the user squeezes the container 15, the cosmetic product 55 at a low temperature is dispensed which provides a moist and refreshing feel to the user and results in cooling down of the body when applied on the user's skin.

In another embodiment of the present invention, container 15 may be in the form of a can. The can may further include thermal container receiving section 45 that is configured to received thermal container 50. Additionally, it should be understood that head 30 may come in the form of a spraying attachment head, configured to spray the product therein when used by a user.

Figure 4:
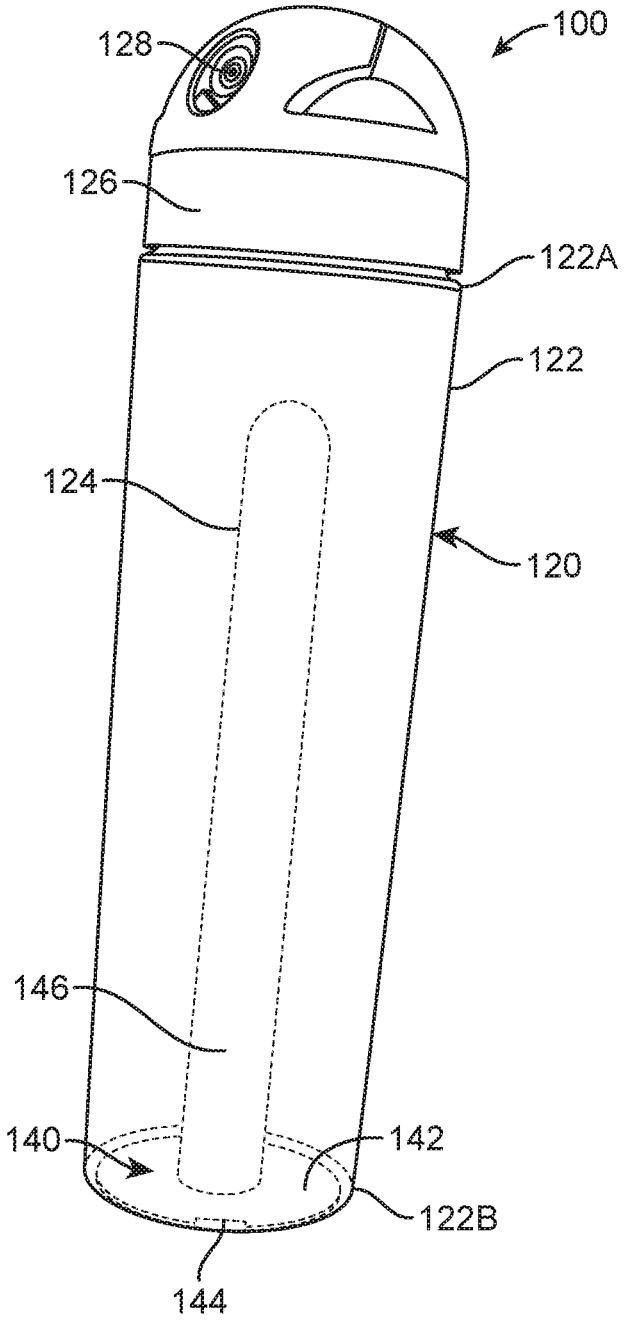
FIG. 4 depicts an isometric view of cosmetic container 100 in accordance to another embodiment of the present invention.
Figure 5:
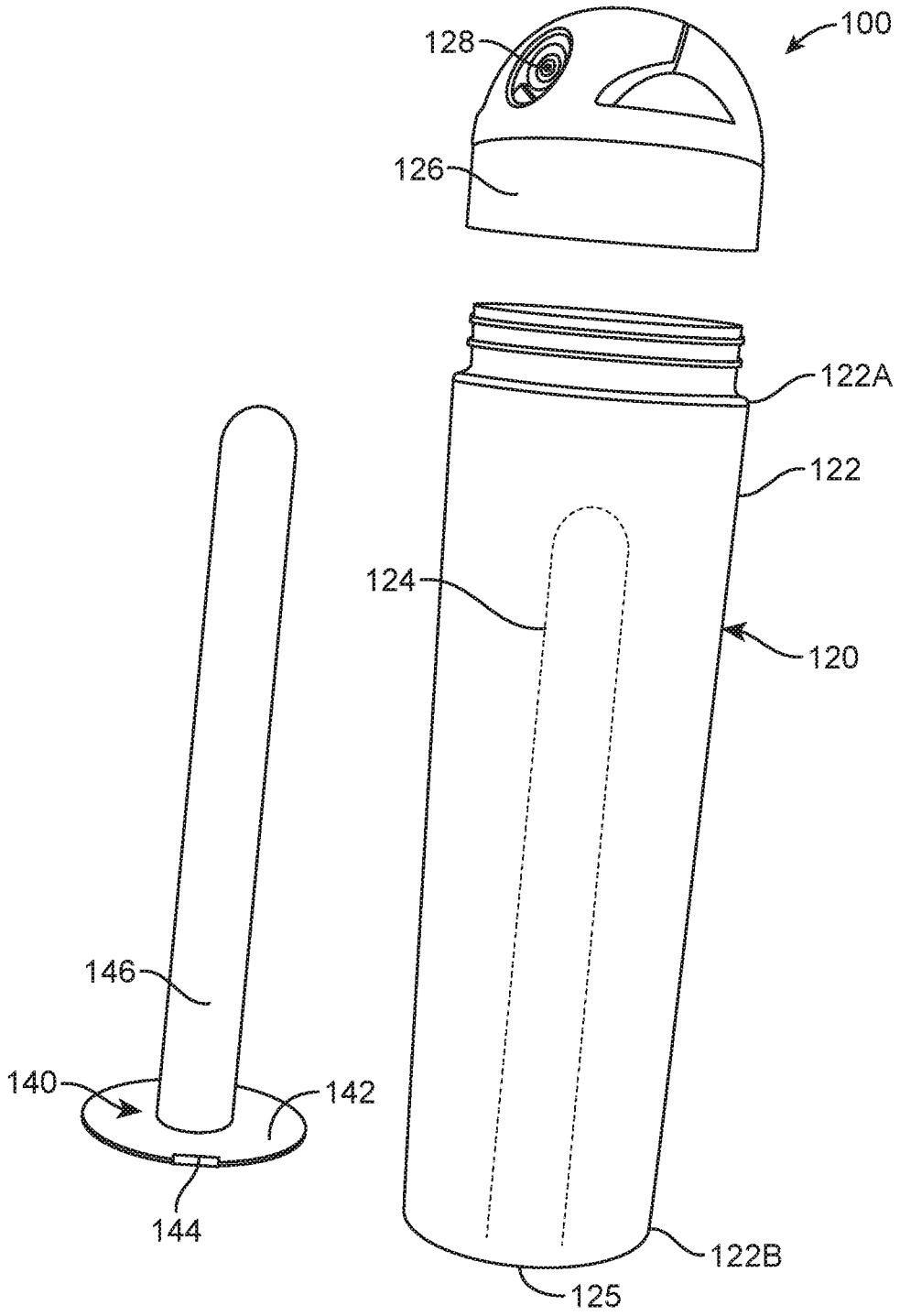
FIG. 5 illustrates an exploded isometric view of cosmetic container 100 in accordance to another embodiment of the present invention.

Various features and embodiments of a cosmetic container are explained in conjunction with the description of FIGS. 4 and 5. It can be observed a system for a cosmetic container 100 in accordance with another embodiment of the present invention which basically includes a container assembly 120 and a thermal assembly 140.

Container assembly 120 includes a container 122 having a top end 122A and a bottom end 122B. In one embodiment, container 122 is provided as having a cylindrical shape. Additionally, container 122 may be made of a metallic thermal material which retains cold temperatures when applied to the material. Furthermore container 122 must be made of suitable materials to contain sensitive substances such as sunscreen, facial cream and the like. Container assembly 120 further includes a cavity 124 extending within container 122. In the present embodiment, cavity 124 partially extends within container 122. Cavity 124 is accessed from an opening 125 located at bottom end 122B and extends upwardly toward top end 122A. In one embodiment, opening 125 is provided as a circular opening which conforms within the bottom shape of container 122. A container portion of container 122 will contain the cosmetic product therein.

Container assembly 120 further includes a cap 126 mounted to a top end 122A of container 122. In one embodiment, cap 126 is provided as a threaded cap which is mounted onto container 122 using a threading locking mechanism. Further, cap 126 may also include a locking mechanism built into it that will prevent users such as children from accidently dispensing the contents of container 122 in a harmful manner. The locking mechanism may be provided as a locking mechanism such that a user may twist the top cap in order to lock the dispensing function of the system. Additionally, cap 126 may also be provided with a pray nozzle 128. Spray nozzle 128 is spraying mechanism which delivers the substance within container 122 in a spray form. This may be provided as a mist with various thickness that may be applied to a user's skin and face. In the present embodiment, cap 126 further contains a press switch that can be actuated to dispense the contents of container 122. Once the switch is actuated, spray nozzle 128 in fluid communication with container 122 will release the contents of container 122 in spray form. In one implementation, container 122 houses a sunblock substance which can be sprayed onto a user's skin to provide protection from the sun.

Thermal assembly 140 includes a base plate 142 having mounting members 144. In the present embodiment, base plate 142 is provided as a circular base plate which includes a shape that conforms to bottom end 122B of container 122. Additionally, base plate 142 may be of dimensions such that opening 125 is entirely covered when mounted thereon. In one implementation, mounting members 144 are mounted to an outer circumference of base plate 142. Additionally, mounting members 144 may be provided as having various forms. In one embodiment, mounting members 144 are provided as snap buttons which onto container 122. In another embodiment, mounting members 144 may be provided as hook and loop fasteners. Additionally, base plate 142 is provided as a removable base plate which is removable from container 122. As a result, container 122 may be washed independently from thermal assembly 140 and additionally thermal assembly 140 may be implemented and reused in other containers.

Thermal assembly 140 further includes a thermal rod 146 which is mounted onto base plate 142. In the present embodiment thermal rod 146 is mounted such that it is vertically mounted and perpendicular to base plate 142. Thermal rod 146 further includes dimensions which corresponds to the shape of cavity 124 of container 122. As a result, thermal rod 146 fits snuggly within cavity 124 to provide a cooling temperature to the substance stored within container 122. Thermal rod 146 is infused a cooling agent that aids in keeping thermal rod 146 at a low temperature. Container 122 is in contact within thermal rod 146 when inserted therein. This will result in the cold temperature of the rod transferring to the surface of container 122 which will in turn cool the substance within. The cooled substance is then dispensed from the spray nozzle 128 and provides a comfortable cooling sensation to a user's skin when applying the substance.

Based on the above, it is evident that the cosmetic container can be used to store cosmetic product at a low temperature, and when applied on user's skin which allows the user to stay cool and comfortable in sun and hot temperatures. It should be understood that the cosmetic product could be provided in variety of forms such as cream, gel-like substance.

The cosmetic product can be make up ingredients such as menthol, oxybenzone and zinc oxide to provide cooling effect and to protect from ultraviolet rays, however a person skilled in the art will understand that other materials in different composition may also be used to make the cosmetic product.

The cosmetic container can be provided in various shapes and sizes depending upon the need.

Although it is explained considering that the cosmetic container is used to store cosmetic product, it should be understood that the cosmetic container could be used to store another products at a low temperature based on the explanation provided above.

The drawings shown herein are provided for illustrative purpose only, and shape and size of each components illustrated should not be construed in limited sense. A person skilled in the art will appreciate that components may be added or deleted to incorporate additional features described in the present disclosure and even such disclosures will be within the scope of the present disclosure.

The foregoing description conveys the best understanding of the objectives and advantages of the present invention. Different embodiments may be made of the inventive concept of this invention. It is to be understood that all matter disclosed herein is to be interpreted merely as illustrative, and not in a limiting sense.

What is claimed is:

1. A system for a cosmetic container, consisting of:

a) a sunblock material;

b) a container assembly including a container having a cylindrical shape with a top end and a bottom end, wherein said container is made of a cylindrical material, said top end having a threaded portion, a cap having an inner threaded portion, wherein said cap is threadedly mounted to said top end of said container, wherein said top cap includes a locking mechanism, said cap further including a spray nozzle in fluid communication with said container, said cap further includes a switch to actuate said spray nozzle, said container further including a cavity extending from said bottom end toward said top end, said container including an opening on said bottom end providing access to said cavity, said sunblock material being stored within said container; and c) a thermal assembly including a base plate having a circular shape with a circumference, wherein a diameter of said base plate corresponds to a diameter of said bottom end of said container, wherein said base plate is made of a metallic material, said base plate including mounting members located along said circumference, wherein said mounting members receive an outer edge of said bottom end to create a secure attachment, said base plate further including a thermal rod containing a cooling agent mounted thereon, wherein said thermal rod is vertically mounted onto said base plate and is placed perpendicular to said base plate, wherein said thermal rod conforms to a shape of said cavity of said container, said thermal rod has a cylindrical shape, wherein the outer surface of said thermal rod is plain, wherein the bottommost end of said thermal rod is sealed by means of said base plate, wherein said base plate and said thermal rod conform a monolithic element, said base plate having a planar surface, said thermal rod is capable of be inserted through said opening into said cavity, said thermal assembly is removable from said cavity.

* * * * *